US009268289B2

(12) United States Patent
Koizumi

(10) Patent No.: US 9,268,289 B2
(45) Date of Patent: Feb. 23, 2016

(54) IMAGE FORMING APPARATUS

(75) Inventor: Kazuhisa Koizumi, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 155 days.

(21) Appl. No.: 13/209,846

(22) Filed: Aug. 15, 2011

(65) Prior Publication Data

US 2012/0045249 A1 Feb. 23, 2012

(30) Foreign Application Priority Data

Aug. 20, 2010 (JP) ..... 2010-185292

(51) Int. Cl.
*G03G 15/14* (2006.01)
*G03G 15/00* (2006.01)

(52) U.S. Cl.
CPC .... *G03G 15/757* (2013.01); *G03G 2215/00075* (2013.01)

(58) Field of Classification Search
CPC ..... G03G 2215/0008; G03G 15/751
See application file for complete search history.

(56) References Cited

U.S. PATENT DOCUMENTS

| | | | | |
|---|---|---|---|---|
| 5,956,552 A | | 9/1999 | Katakabe | |
| 5,995,802 A | * | 11/1999 | Mori et al. | 399/394 |
| 6,173,141 B1 | | 1/2001 | Sakagami et al. | |
| 2009/0285594 A1 | * | 11/2009 | Kichise et al. | 399/75 |

FOREIGN PATENT DOCUMENTS

| | | | | |
|---|---|---|---|---|
| JP | 2005-128052 A | | 5/2005 | |
| JP | 2005128052 A | * | 5/2005 | G03G 15/01 |
| JP | 2007-101999 A | | 4/2007 | |
| JP | 2008-197146 A | | 8/2008 | |
| JP | 2009-128810 A | | 6/2009 | |
| JP | 2009-276519 A | | 11/2009 | |

OTHER PUBLICATIONS

Machine translation of Shiratori, JP 2005-128052.*
Yamamoto et al., Electrophotographic Color Print Engine, OKI Technical Review, Aug. 1998, vol. 64, pp. 15-20.*

* cited by examiner

*Primary Examiner* — David Gray
*Assistant Examiner* — Sevan A Aydin
(74) *Attorney, Agent, or Firm* — Canon USA Inc. IP Division

(57) ABSTRACT

An image forming apparatus includes a first photosensitive member and a second photosensitive member that form images having different colors, a transfer belt that transfers the images formed on the first photosensitive member and the second photosensitive member onto a recording sheet, a first motor that rotatingly drives the first photosensitive member and the transfer belt, and a second motor that rotatingly drives the second photosensitive member. After the startup process of the first and second motors has been completed, the rotation speed of the second motor is controlled while maintaining the rotation speed of the first motor unchanged so that the second rotation phase of the second photosensitive member rotatingly driven by the second motor is the same as the first rotation phase of the first photosensitive member rotatingly driven by the first motor.

6 Claims, 6 Drawing Sheets

IMAGE FORMING APPARATUS

BACKGROUND OF THE INVENTION

1. Field of the Invention

The present invention relates to an image forming apparatus that controls the rotation phases of a plurality of photosensitive members.

2. Description of the Related Art

In recent years, electrophotographic color image forming apparatuses of a tandem type have been in widespread use. In image forming apparatuses of a tandem type, toner images of individual colors are formed on a plurality of photosensitive drums, and the toner images of the individual colors are overlaid and transferred onto a recording sheet. Electrophotographic color image forming apparatuses of a tandem type have an advantage over color image forming apparatuses that form an image using a single photosensitive drum in terms of the productivity of image formation. However, color image forming apparatuses of a tandem type may cause color misregistration in which the relative positions of the toner image of individual colors are shifted when the toner images formed on the photosensitive drums are overlaid. In such a case, an unclear and low-quality image is formed on a recording sheet.

One of the reasons for causing color misregistration is a shift of rotation phase among the plurality of photosensitive drums. The eccentricity of the photosensitive drum with respect to the rotation shaft causes the peripheral speed to periodically vary. If the phases of periodical variations in the peripheral speeds of the photosensitive drums are not the same, increases or decreases in the peripheral speeds of the photosensitive drums are not the same. Therefore, shifts of the relative positions of toner image of individual colors become noticeable. To address such an issue, U.S. Pat. No. 6,173,141 describes an image forming apparatus that prevents color misregistration by performing control so that the rotation phases of the photosensitive drums are the same. In the image forming apparatus described in U.S. Pat. No. 6,173,141, a microprocessor receives the rotation speed of a photosensitive drum for color image formation and the rotation speed of a photosensitive drum for monochrome image formation and controls a drive motor for driving the photosensitive drum for color image formation, a drive motor for driving the photosensitive drum for monochrome image formation, and a drive motor for driving a transfer conveyer belt so that the variation cycles of the two drums are synchronized with each other.

A variety of techniques for phasing two photosensitive drums have been proposed. One of the techniques is to increase or decrease one of the rotation speeds of the two photosensitive drums after the rotation speeds have reached the rotation speed for image formation. If the intention is only to make two photosensitive drums be in phase, the rotation speed of either photosensitive drum can be changed. However, when the drive motor that drives the photosensitive drum for monochrome image formation also drives the transfer conveyer belt and if the two photosensitive drums are made to be in phase, the following problems arise.

That is, if the photosensitive drum for monochrome image formation is accelerated, a roller for driving the transfer conveyer belt is also accelerated. The transfer conveyer belt is stretchable. Accordingly, if the roller for driving the transfer conveyer belt is accelerated, part of the transfer conveyer belt that is pulled by the roller stretches, and part of the transfer conveyer belt that is fed by the roller is loosened. This gradually disappears due to the restoration force of the transfer conveyer belt. However, the restoration force serves as a disturbance and is applied to the roller. Therefore, it takes a relatively long time until the rotation speed of the roller reaches a predetermined stable speed through feedback control. Such a problem also arises when, in image forming apparatuses that transfer a toner image formed on a photosensitive drum onto a recording sheet via an intermediate transfer belt, the phase of the photosensitive drum is made the same as that of another photosensitive drum by increasing or decreasing the rotation speeds of drive motor for driving the photosensitive drum and the intermediate transfer belt. As described above, in order to make the two photosensitive drums be in phase, which one of the photosensitive drums is selected for increasing or decreasing the rotation speed needs to be determined.

SUMMARY OF THE INVENTION

According to an embodiment of the present invention, an image forming apparatus includes a first photosensitive member and a second photosensitive member that are rotation members, an image forming unit configured to form images on the first photosensitive member and the second photosensitive member, a belt configured to transfer the images formed on the first photosensitive member and the second photosensitive member onto a recording sheet, a first drive unit configured to rotatingly drive the first photosensitive member and the belt, a second drive unit configured to rotatingly drive the second photosensitive member, a first detection unit configured to detect the rotation phase of the first photosensitive member, a second detection unit configured to detect the rotation phase of the second photosensitive member, and a control unit configured to perform control on the basis of the results of detection performed by the first detection unit and the second detection unit so that a phase difference in rotation speed between the first photosensitive member and the second photosensitive member is less than or equal to a predetermined value by increasing or decreasing the rotation speed of the second drive unit while maintaining the rotation speed of the first drive unit unchanged.

Further features of the present invention will become apparent from the following description of exemplary embodiments with reference to the attached drawings.

DESCRIPTION OF THE EMBODIMENTS

Figure 1:
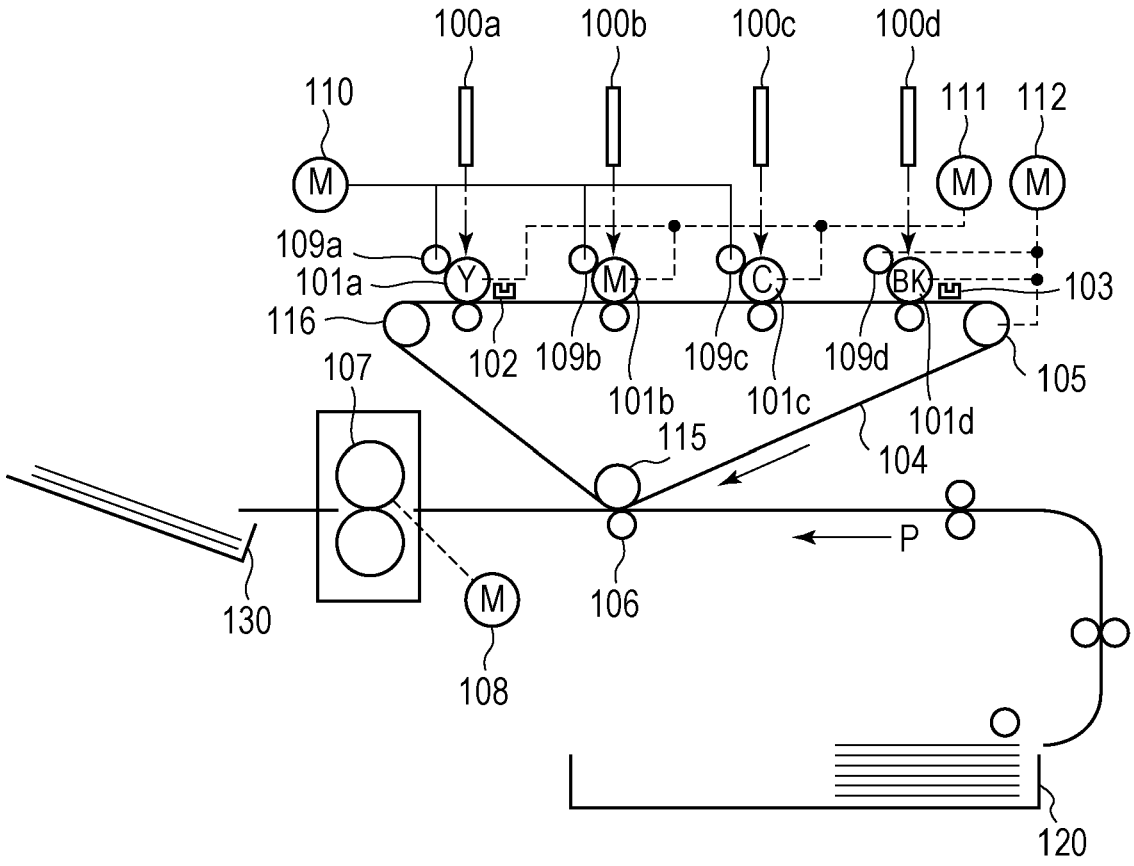
FIG. 1 is a schematic illustration of the configuration of an image forming apparatus according to an embodiment of the present invention.

FIG. 1 is a schematic illustration of the configuration of an image forming apparatus according to an embodiment of the present invention. A portion in which a latent image is formed and a toner image is transferred onto a recording sheet is primarily illustrated in FIG. 1. The image forming apparatus is an electrophotographic color image forming apparatus of a tandem type. The image forming apparatus includes four image forming units for forming a yellow image, a magenta image, a cyan image, and a black image.

Each of the image forming units includes one of photosensitive drums 101*a* to 101*d* serving as rotation members. Note that suffixes "a" to "d" of the reference numerals 101*a* to 101*d* for the photosensitive drums indicate "yellow", "magenta", "cyan", and "black", respectively. That is, the photosensitive drum 101*a* is a photosensitive member for forming a yellow image, the photosensitive drum 101*b* is a photosensitive member for forming a magenta image, the photosensitive drum 101*c* is a photosensitive member for forming a cyan image, and the photosensitive drum 101*d* is a photosensitive member for forming a black image. Note that the photosensitive drums 101*a* to 101*d* are also collectively referred to as a "color photosensitive member" for forming a color image. Such definition for the suffixes a to d also apply to laser scanners 100*a* to 100*c* and a laser scanner 100*d*, and developing units 109*a* to 109*c* and a developing unit 109*d*.

The photosensitive drums 101*a* to 101*c* are driven by a drive motor 111 for a color photosensitive drum via, for example, gears. The photosensitive drum 101*d* is driven by a drive motor 112 for a monochrome photosensitive drum. The drive motors 111 and 112 are DC brushless motors. The photosensitive drums 101*a* to 101*c* are assembled so that eccentric components with the rotation axis of the photosensitive drum and the rotation axis of the gear cancel each other out and the cycles of a peripheral speed variation caused by the eccentricity of the photosensitive drums 101*a* to 101*c* have the same phase. Since the photosensitive drums 101*a* to 101*c* are driven by a single drive motor 111, the photosensitive drums 101*a* to 101*c* revolve with the same phase. Accordingly, the photosensitive drums 101*a* to 101*c* are rotatingly driven while keeping the phases thereof the same. The rotation phases of the photosensitive drums 101*a* to 101*c* are detected by a phase detection sensor 102. The configuration of the phase detection sensor 102 is described in more detail below. The developing unit 109*d* and a driving roller 105 are driven by the drive motor 112. That is, the photosensitive drum 101*d*, the developing unit 109*d*, and the driving roller 105 are driven by the single drive motor 112. The rotation phase of the photosensitive drum 101*d* is detected by a phase detection sensor 103. The configuration of the phase detection sensor 103 is described in more detail below. The developing units 109*a* to 109*c* are driven by a color developing unit drive motor 110.

Each of the developing units 109*a* to 109*d* deposits toner (a developer) on a latent image formed on one of the photosensitive drums 101*a* to 101*d*. Thus, the latent image is visualized. The latent image on each of the photosensitive drums 101*a* to 101*d* is formed through exposure performed by one of the laser scanners 100*a* to 100*d* on the basis of an image signal. The toner images, which are visible images, formed on the photosensitive drums 101*a* to 101*d* are sequentially transferred onto an intermediate transfer belt 104 rotated by the driving roller 105.

The toner images transferred onto the intermediate transfer belt 104 are transferred onto a recording sheet by a transfer roller 106 at the same time. The recording sheet having the toner images transferred thereonto is conveyed into a fuser unit 107 including a fusing roller rotated by a fuser drive motor 108. In the fuser unit 107, the toner images are fixed to the recording sheet by using heat.

According to the present embodiment, upon receiving a print instruction, the image forming apparatus sends image signals of individual colors to the laser scanners 100*a* to 100*d*, and latent images are formed on the photosensitive drums 101*a* to 101*d*. The four-color latent images formed on the photosensitive drums 101*a* to 101*d* are developed with toner by the developing units 109*a* to 109*d*, respectively. The four-color toner images formed on the photosensitive drums 101*a* to 101*d* are transferred onto the intermediate transfer belt 104 rotated by the driving roller 105 in a clockwise direction so as to be overlaid on one another. The intermediate transfer belt 104 is kept tight between the driving roller 105 and each of driven rollers 115 and 116.

Subsequently, a recording sheet is conveyed from a paper feed cassette 120 in a direction indicated by an arrow P. The toner image formed on the intermediate transfer belt 104 is transferred onto the recording sheet by the transfer roller 106. The toner image transferred onto the recording sheet is fixed to the recording sheet by the fusing roller 107 using heat and pressure. Thereafter, the recording sheet is ejected onto a paper output tray 130.

Figure 2:
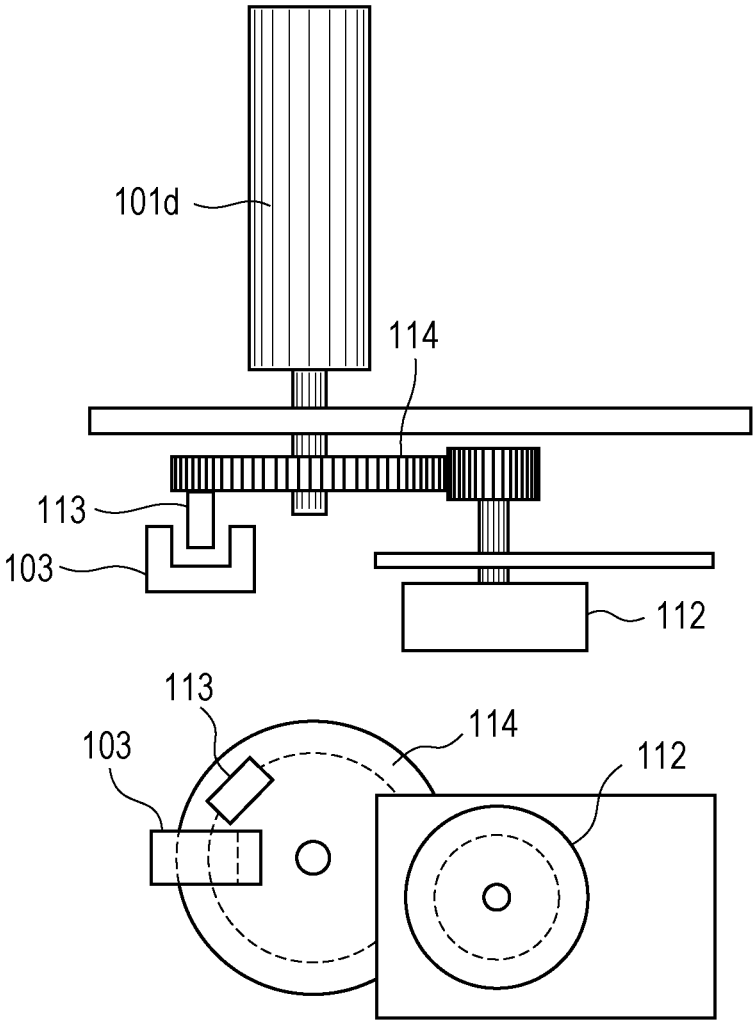
FIG. 2 illustrates the configuration of a driving system for a photosensitive drum.

FIG. 2 illustrates the configuration of a driving system for the photosensitive drum 101*d*. A gear 114 is attached to the photosensitive drum 101*d*. The gear 114 drives the photosensitive drum 101*d* while rotating together with the photosensitive drum 101*d*. The gear 114 is driven by the drive motor 112. The gear 114 includes a flag 113. The flag 113 is made of a non-transparent material. With the rotation of the gear 114, the flag 113 passes between a light emitter and a photodetector of the phase detection sensor 103. The phase detection sensor 103 outputs a low level signal when the photodetector receives the light that is not interrupted by the flag 113. In contrast, the phase detection sensor 103 outputs a high level signal when the flag 113 interrupts the light and the photodetector does not receive the light. In this way, while the photosensitive drum 101*d* rotates through one revolution, a pulse signal is output once and, therefore, the rotation phase of the photosensitive drum 101*d* can be detected. The configuration of a driving system for driving the photosensitive drums 101*a* to 101*c* is similar to that for the photosensitive drum 101*d* except that the single drive motor 111 transfers a rotational force to each of the gears of the photosensitive drums 101*a* to 101*c*. In addition, the configuration of the phase detection sensor 102 is similar to that of the phase detection sensor 103. Thereafter, the rotation speeds of the drive motor 111 and the drive motor 112 are controlled so that the phases of the photosensitive drums 101*a*, 101*b*, and 101*c* detected by the phase detection sensor 102 are the same as the phase of the photosensitive drum 101*d* detected by the phase detection sensor 103. In this way, a difference between the peripheral speeds of the photosensitive drums 101*a* to 101*d* can be reduced. That is, the rotation speeds of the drive motors 111 and 112 are controlled so that the phase of the photosensitive drums 101*a* to 101*c* and the phase of the photosensitive drum 101*d* detected by the phase detection sensor 103 have a predetermined relationship. In this manner, color misregistration, that is, the shift of the position of each of the color images can be prevented.

Note that a flag may be provided on the photosensitive drum 101*d* or a shaft that is integrated into the photosensitive drum 101*d*, and the flag may block the light incident on the phase detection sensor 103. Alternatively, a plurality of flags having different widths may be provided, and a plurality of signals may be output during one revolution of the photosensitive drum 101*d*.

Figure 3:
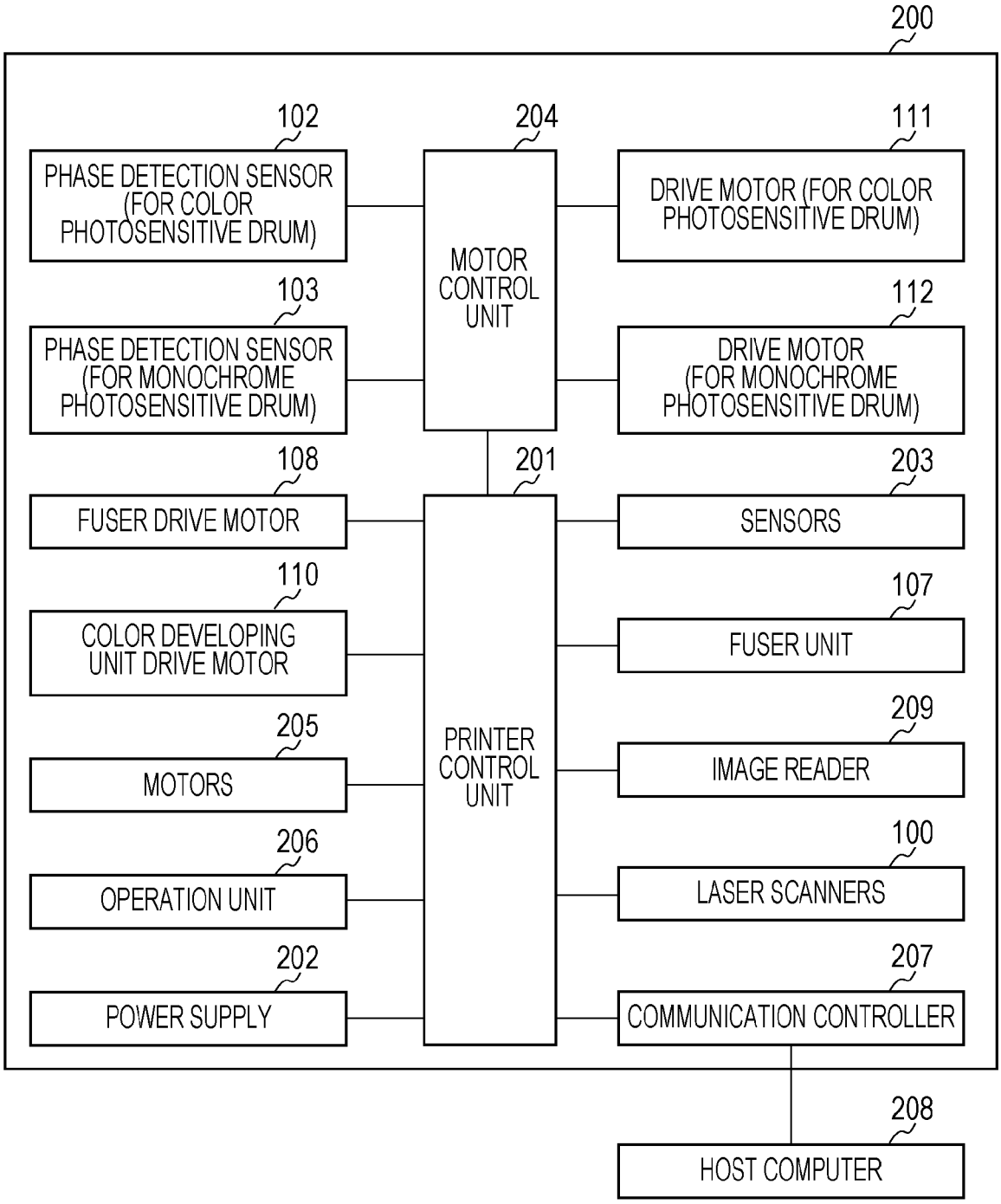
FIG. 3 is a control block diagram of a printer unit of the image forming apparatus.

FIG. 3 is a control block diagram of a printer unit 200 of the image forming apparatus. Each component of the printer unit 200 is controlled by a printer control unit 201. The printer control unit 201 includes a digital signal processor (DSP) or an application specific Integrated Circuit (ASIC) and a central processing unit (CPU). The phase detection sensors 102 and 103 and the drive motors 111 and 112 are controlled by a motor control unit 204. The motor control unit 204 includes a DSP or an ASIC and a CPU.

The motor control unit 204 changes the phases of the drive motors 111 and 112 in accordance with a rotor position signal received from the DC brushless motor and starts and stops the drive motors 111 and 112 in response to a start/stop instruction signal received from the printer control unit 201. In addition, the motor control unit 204 detects the rotation speed of the photosensitive drum 101*a* from the cycle of a signal output from the phase detection sensor 102 and detects the rotation speed of the photosensitive drum 101*d* from the cycle of a signal output from the phase detection sensor 103. Furthermore, the motor control unit 204 compares a speed instruction signal received from the printer control unit 201 with the rotation speeds of the photosensitive drums 101*a* and 101*d* and controls the rotation speeds of the drive motors 111 and 112. The motor control unit 204 outputs pulse signals received from the phase detection sensors 102 and 103 to the printer control unit 201. Still furthermore, the motor control unit 204 outputs, to the printer control unit 201, the rotation speed of the photosensitive drums 101*a* to 101*c* detected on the basis of the pulse signal received from the phase detection sensor 102 and the rotation speed of the photosensitive drum 101*d* detected on the basis of the pulse signal received from the phase detection sensor 103.

The fuser drive motor 108, the color developing unit drive motor 110, and the laser scanners 100*a* to 100*d* are controlled by the printer control unit 201. The printer control unit 201 and electrical components and electrically-driven components included in the image forming apparatus operate using the power supplied from a power supply 202. The printer control unit 201 controls motors 205 (e.g., a drive motor for driving rollers that convey the recording sheet), the drive motors 111 and 112, laser scanners 100 (100*a* to 100*d*), the fuser drive motor 108, and a fuser unit 107 in accordance with signals input from sensors 203 that detect a variety of states of sub-units of the printer unit 200 and signals input from the phase detection sensors 102 and 103. The printer control unit 201 causes an operation unit 206 to display the operation status of the image forming apparatus. Communication between the printer control unit 201 of the image forming apparatus and a host computer 208 is performed via a communication controller 207. For example, print data is transmitted from the host computer 208 to the image forming apparatus, and data indicating the print status is transmitted from the printer control unit 201 of the image forming apparatus to the host computer 208. Furthermore, the printer control unit 201 causes the laser scanners 100 (100*a* to 100*d*) to emit laser beams on the basis of the print data. Still furthermore, upon receiving a copy start instruction from the operation unit 206, the printer control unit 201 causes an image reader 209 to read the image of a document and causes the laser scanners 100 to emit laser beams on the basis of document image data output from the image reader 209.

Figure 4A:
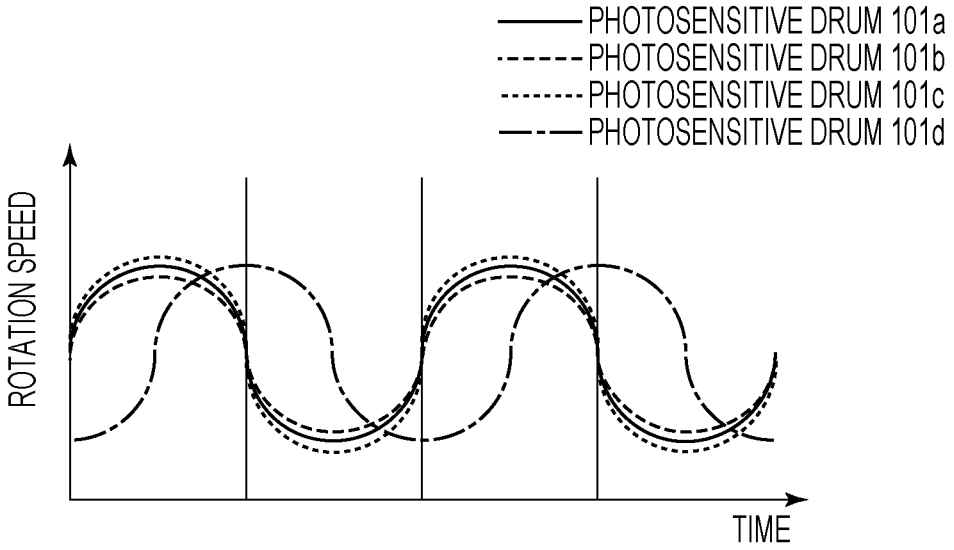
FIGS. 4A and 4B illustrate phasing of rotating photosensitive drums with respect to the rotating photosensitive drum shown in FIG. 2.
Figure 4B:
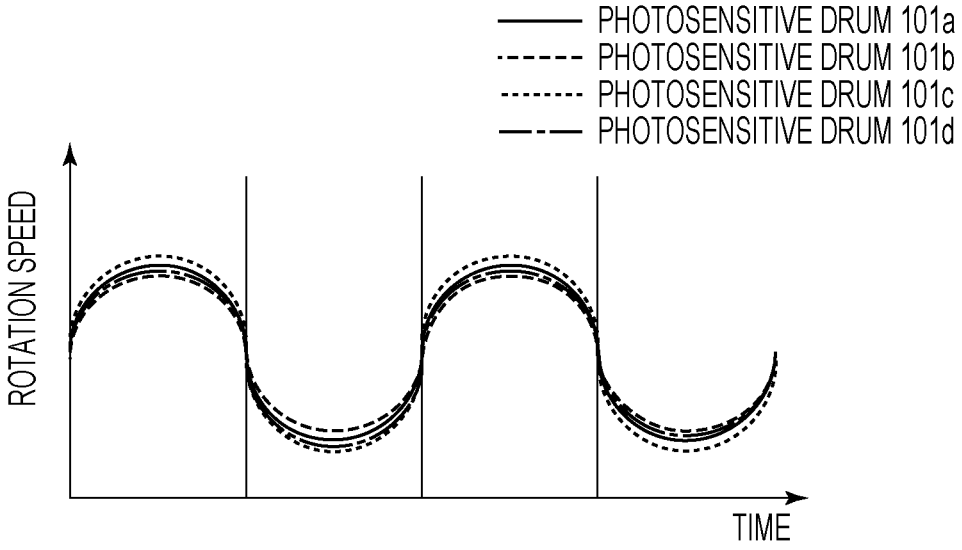

FIGS. 4A and 4B illustrate phasing of the rotating photosensitive drums 101*a* to 101*c* with respect to the rotating photosensitive drum 101*d*. FIG. 4A illustrates the phase of the photosensitive drums 101*a* to 101*c* that differs from the phase of the photosensitive drum 101*d* by 90°. As described above, the photosensitive drums 101*a* to 101*c* are assembled so as to have the same phase and are driven using the single drive motor 111. Accordingly, the photosensitive drums 101*a* to 101*c* rotate with the same phase. In contrast, the photosensitive drums 101*a* to 101*c* and the photosensitive drum 101*d* are driven using different drive motors. Accordingly, a difference between the phase of the photosensitive drums 101*a* to 101*c* and the phase of the photosensitive drum 101*d* is detected and, thereafter, control is performed so that the photosensitive drums 101*a* to 101*c* and the photosensitive drum 101*d* are phased. The rotation phases of the photosensitive drums 101*a* to 101*d* are detected by the phase detection sensors 102 and 103, and the printer control unit 201 detects the difference between the phases on the basis of the result of detection.

FIG. 4B illustrates the phase of the rotating photosensitive drums 101*a* to 101*c* that is the same as the phase of the rotating photosensitive drum 101*d*. Such phases can be realized by the printer control unit 201 controlling the drive motors 111 and 112 via the motor control unit 204 so that a difference between the rotation phase of the photosensitive drum 101*a* detected by the phase detection sensor 102 and the rotation phase of the photosensitive drum 101*d* detected by the phase detection sensor 103 is zero (i.e., no phase difference). By eliminating phase difference between the photosensitive drums 101*a* to 101*d*, the occurrence of color misregistration can be prevented. According to the present embodiment, by setting the difference between the rotation phase of the photosensitive drums 101*a* to 101*c* and the rotation phase of the photosensitive drum 101*d* to a value less than or equal to a predetermined value, the occurrence of color misregistration can be prevented.

Figure 5:
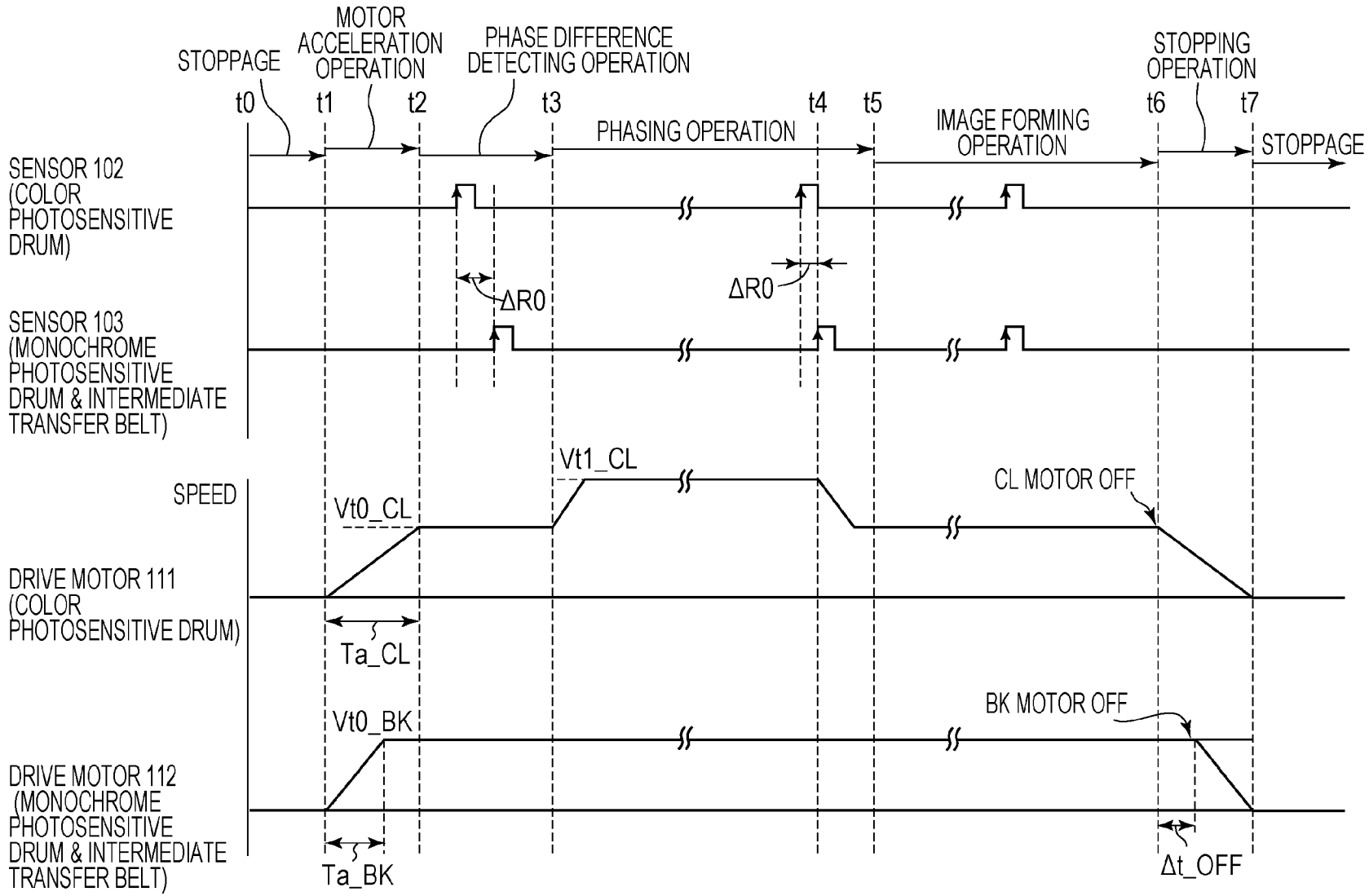
FIG. 5 is a timing diagram of phase detection sensors and drive motors in phasing control of the photosensitive drums.

FIG. 5 is a timing diagram of the phase detection sensors 102 and 103 and the drive motors 111 and 112 in phasing control between the phase of the photosensitive drums 101*a* to 101*c* and the phase of the photosensitive drum 101*d*. The timing diagram section for the phase detection sensors 102 and 103 shows pulse signals output per one revolution of a photosensitive drum. In contrast, the timing diagram section for the drive motors 111 and 112 shows the rotation speeds of the drive motors 111 and 112.

At a time t0, the photosensitive drums 101*a* to 101*c* and the photosensitive drum 101*d* are stationary while keeping a predetermined phase relationship. At a time t1, the drive motors 111 and 112 start driving at the same time. The drive motor 111 is accelerated to a rotation speed of Vt0_CL required for image formation. The drive motor 112 is accelerated to a rotation speed of Vt0_BK required for image formation. When the diameters of the photosensitive drums 101*a* to 101*c* and the photosensitive drum 101*d* are the same and if the gear ratio of the drive motor 111 to each of the photosensitive drums 101*a* to 101*c* and the gear ratio of the drive motor 112 to the photosensitive drum 101*d* are the same, the rotation speeds Vt0_CL and Vt0_BK are the same. The rotation speed of the drive motor 111 reaches the rotation speed Vt0_CL after a period of time Ta_CL has elapsed since the drive motor 111 started driving. In contrast, the rotation speed of the drive motor 112 reaches the rotation speed Vt0_BK after a period of time Ta_BK has elapsed since the drive motor 112 started driving. At that time, control is performed so that after the drive motors 111 and 112 reach the rotation speeds for image formation, the rotation speeds for image formation remain unchanged.

Subsequently, at a time t2, detection of a difference between the phase of the photosensitive drums 101*a* to 101*c* and the phase of the photosensitive drum 101*d* is started. The phase detection sensor 102 outputs a pulse signal when the photosensitive drums 101*a* to 101*c* are at a predetermined rotation angle. The phase detection sensor 103 outputs a pulse signal when the photosensitive drum 101*d* is at a predetermined rotation angle. The configuration is designed so that if a point in time at which the pulse signal of the phase detection sensor 102 rises is the same as a point in time at which the pulse signal of the phase detection sensor 103 rises, the phase of the photosensitive drums 101*a* to 101*c* is the same as the phase of the photosensitive drum 101*d*. FIG. 5 illustrates the phase of the photosensitive drums 101*a* to 101*c* detected by the phase detection sensor 102 that lags behind the phase of the photosensitive drum 101*d* detected by the phase detection sensor 103 by a phase difference ΔR0.

At a time t3, the drive motor 111 having a lagging phase is made to accelerate to a rotation speed Vt1_CL that is higher than the rotation speed Vt0_CL. In this way, the lagging phase of the photosensitive drums 101*a* to 101*c* catches up the phase of the photosensitive drum 101*d*. Subsequently, at a time t4 at which the phase difference ΔR0 between the pulse signals output from the phase detection sensors 102 and 103 becomes smaller than or equal to a predetermined value, the rotation speed of the drive motor 111 is changed back to the rotation speed Vt0_CL. The predetermined value of the phase difference is used for determining a point in time at which the drive motor 111 rotating at a rotation speed of Vt1_CL is made to start to decelerate. This predetermined value of the phase difference is set to a value that makes the phase of the photosensitive drums 101*a* to 101*c* the same or substantially the same as the phase of the photosensitive drum 101*d* when the drive motor 111 decelerates to the rotation speed Vt0_CL, that is, a value that makes the difference between the phase of the pulse signal of the phase detection sensor 102 and the phase of the pulse signal of the phase detection sensor 103 zero or substantially zero. In this way, the difference between the phase of the photosensitive drums 101*a* to 101*c* and the phase of the photosensitive drum 101*d* can be set to a value smaller than or equal to the predetermined value. Thereafter, image formation is started at a time t5 and ends at a time t6. At the time t6 at which an image forming operation ends, deceleration of the drive motor 111 is started. At a time at which a period of time ΔT_OFF has elapsed since the time t6, deceleration of the drive motor 112 is started. The period of time ΔT_OFF is a time difference for stopping the drive motors 111 and 112 at the same time. At a time t7, the drive motors 111 and 112 stop with a predetermined phase relationship therebetween.

As described above, according to the present embodiment, the drive motors 111 and 112 are started so that the phase of the photosensitive drums 101*a* to 101*c* (color photosensitive drums) lags behind the phase of the photosensitive drum 101*d* (a monochrome photosensitive drum). That is, when the startup process of the drive motors 111 and 112 is completed, the phase of the photosensitive drums 101*a* to 101*c*, which are targets of rotation speed control, lags behind the phase of the photosensitive drum 101*d*, which is not a target of rotation speed control, in a phasing process. As used herein, the term "time when the startup process of the drive motors 111 and 112 is completed" refers to a time when the rotation speed of the photosensitive drums 101*a* to 101*c* (color photosensitive drums) and the rotation speed of the photosensitive drum 101*d* (a monochrome photosensitive drum) reach predetermined constant speeds for image formation. Subsequently, the drive motor 112 is continuously rotated at the rotation speed for image formation, and the drive motor 111 is rotated at a rotation speed that is higher than the rotation speed for image formation. In this way, the lagging phase of the photosensitive drums 101*a* to 101*c* catches up the phase of the photosensitive drum 101*d*. The reason for performing such a phasing process in the present embodiment is as follows.

As described above, the drive motor 112 drives the photosensitive drum 101*d* and the intermediate transfer belt 104. The intermediate transfer belt 104 is held tight between the driving roller 105 and each of the driven rollers 115 and 116. The driving force is supplied from only the driving roller 105. In addition, the intermediate transfer belt 104 is formed of, for example, polyimide, and is stretchable. Accordingly, if the driving roller 105 is accelerated, part of the intermediate transfer belt 104 between the driving roller 105 and the driven roller 116 stretches, and part of the intermediate transfer belt 104 between the driving roller 105 and the driven roller 115 is loosened. This gradually disappears due to the restoration force of the intermediate transfer belt 104. However, the restoration force serves as a disturbance and is applied to the driving roller 105. Therefore, it takes a relatively long time until the rotation speed of the driving roller 105 reaches a predetermined stable speed through feedback control. In contrast, the drive motor 111 that drives the photosensitive drums 101*a* to 101*c* does not drive a stretchable member, such as an intermediate transfer belt. As a result, a disturbance applied when the drive motor 111 is accelerated is smaller than that applied to the drive motor 112 and, therefore, a feed back control time required for making the accelerated speed of the drive motor 111 stable is smaller.

In consideration of such a characteristic, according to the present embodiment, the drive motors 111 and 112 are started so that the phase of the photosensitive drums 101*a* to 101*c* (the color photosensitive drums) lags behind the phase of the photosensitive drum 101*d* (the monochrome photosensitive drum). Thereafter, the rotation speed of the drive motor 112 that drives the intermediate transfer belt 104 and the photosensitive drum 101*d* remains unchanged, and the rotation speed of the drive motor 111 that drives the photosensitive drums 101*a* to 101*c* is accelerated. In this way, the photosensitive drums are phased.

In this way, phasing of the photosensitive drums and control of the rotation speeds of the photosensitive drums can be performed in a short time and, therefore, an operation for forming a high-quality image can be started in a short time. In addition, according to the present embodiment, in the phasing process, the phase of the photosensitive drums 101*a* to 101*c* (the color photosensitive drums) can be set so that the rotation speed of the photosensitive drum 101*d* (the monochrome photosensitive drum) is not lower than the rotation speed for image formation. It is known that driving of a drive motor is not stable at a low speed. By performing control as in the present embodiment, driving of the drive motor is not performed within the unstable range of the rotation speed. Thus, phasing of the photosensitive drums and control of the rotation speeds of the photosensitive drums can be performed in a short time.

Figure 6:
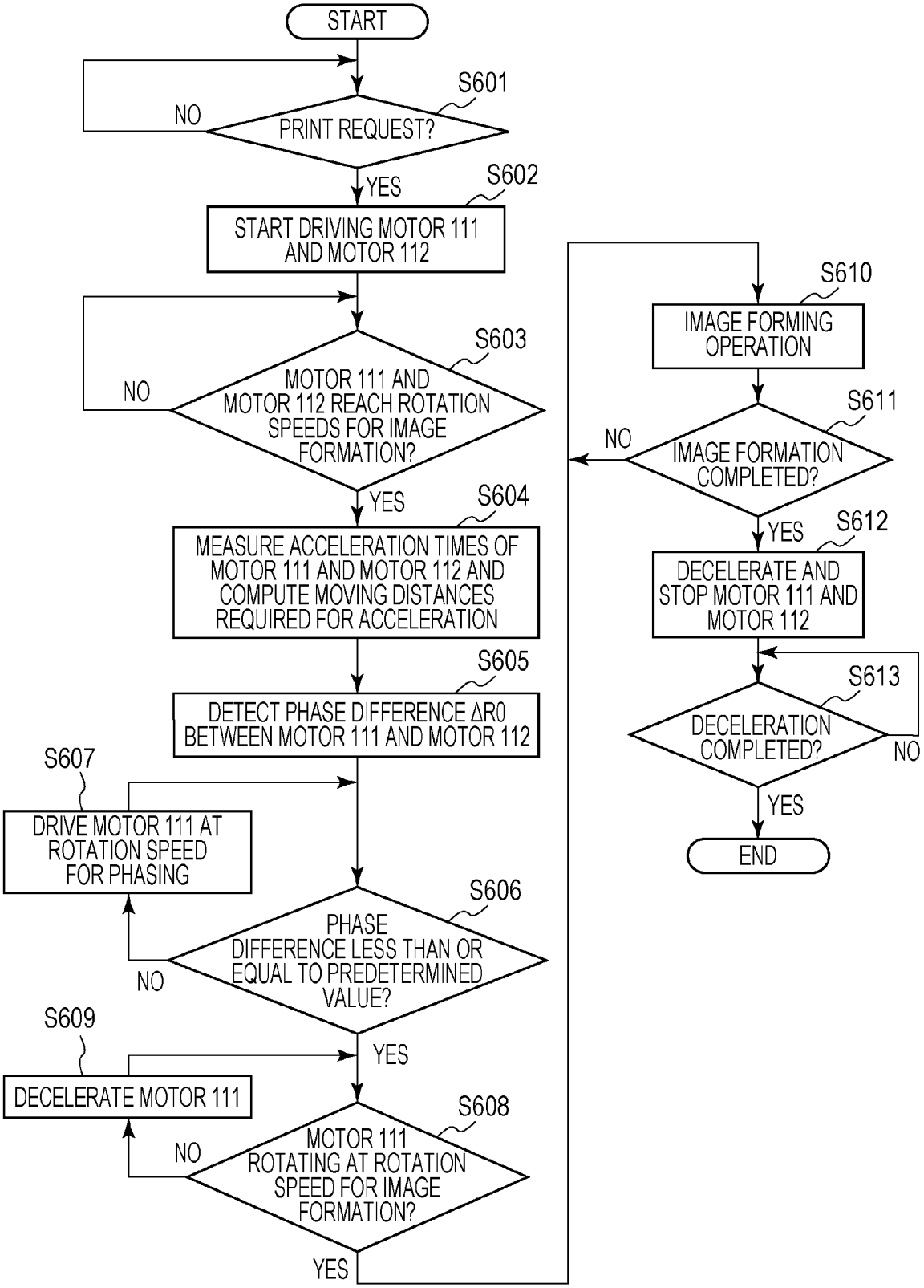
FIG. 6 is a flowchart of control of the drive motors performed by a printer control unit.

FIG. 6 is a flowchart of control of the drive motors 111 and 112 performed by the printer control unit 201. Upon receiving a print request from the host computer 208 or a copy start instruction input from the operation unit 206 (step S601), the printer control unit 201 starts driving the drive motors 111 and 112 (step S602). When the rotation speed of the drive motor 111 reaches the rotation speed Vt0_CL for image formation and if the rotation speed of the drive motor 112 reaches the rotation speed Vt0_BK for image formation (step S603), control is performed so that the drive motor 111 maintains the rotation speed Vt0_CL and the drive motor 112 maintains the rotation speed Vt0_BK. In addition, an acceleration time Ta_CL for the drive motor 111 and an acceleration time Ta_BK for the drive motor 112 are identified, and the moving distances (the angles) needed for the acceleration for the drive motors 111 and 112 are computed (step S604). For example, when the rotation speed Vt0_CL for image formation is the same as the rotation speed Vt0_BK for image formation and if the speed variation at an acceleration time is linear, moving distances R_CL needed for the acceleration of the drive motor 111 and R_BK needed for the acceleration of the drive motor 112 are expressed as follows:

$$R_CL=(Vt0_CL\times Ta_CL)/2, \text{ and}$$

$$R_BK=(Vt0_BK\times Ta_BK)/2.$$

Subsequently, the phase difference ΔR0 between the phase of the photosensitive drums 101*a* to 101*c* and the phase of the photosensitive drum 101*d* is detected on the basis of the pulse signals output from the phase detection sensor 102 and the phase detection sensor 103 while the drive motor 111 and the drive motor 112 are rotating at constant speeds (step S605). The phase difference ΔR0 can be detected by counting the number of basic clocking signals supplied from the printer control unit 201 from the rising edge of the pulse signal output from the phase detection sensor 102 to the falling edge of the pulse signal output from the phase detection sensor 103.

Thereafter, it is determined whether the phase difference ΔR0 is less than or equal to a predetermined value (step S606). If the detected phase difference ΔR0 is greater than the predetermined value, the drive motor 111 is rotated at the rotation speed Vt1_CL that is higher than the rotation speed Vt0_CL (step S607). If, in step S606, the detected phase difference ΔR0 is less than or equal to the predetermined value, it is determined whether the drive motor 111 is rotating at the rotation speed for image formation (step S608). If the drive motor 111 is not rotating at the rotation speed Vt0_CL for image formation, the drive motor 111 is decelerated (step S609). If, in step S609, the rotation speed of the drive motor 111 reaches the rotation speed for image formation, the rotation speeds of the drive motor 111 and the drive motor 112 are maintained at the rotation speeds for image formation. Subsequently, an image forming operation is started (step S610).

After the image forming operation has been completed (step S611), the drive motor 111 and the drive motor 112 are stopped (step S612). In order to stop the drive motors 111 and 112, electrical currents supplied to the drive motors 111 and 112, which are brushless motors, are turned off. At that time, the points in time at which the electrical currents supplied to the drive motors 111 and 112 are turned off are controlled so that the phase of the photosensitive drums 101*a* to 101*c* lags behind the phase of the photosensitive drum 101*d* when the drive motors 111 and 112 are started next time. In addition, the points in time at which the electrical currents supplied to the drive motors 111 and 112 are turned off are controlled so that the photosensitive drums 101*a* to 101*c* and the photosensitive drum 101*d* are stopped at the same time. For example, the stopping operation for the drive motors 111 and 112 is started at such points in time that the phase of the photosensitive drums 101*a* to 101*c* is the same as the phase of the photosensitive drum 101*d* when the photosensitive drums 101*a* to 101*c* and the photosensitive drum 101*d* are stopped at the same time. According to the present embodiment, the startup of the drive motor 111 is delayed so as to be after that of the drive motor 112. Accordingly, if the drive motor 111 and the drive motor 112 are started with the phase of the photosensitive drums 101*a* to 101*c* being the same as that of the photosensitive drum 101*d*, the phase of the photosensitive drums 101*a* to 101*c* lags behind the phase of the photosensitive drum 101*d*. According to the present embodiment, the point in time at which deceleration of the drive motor 112 is started is delayed so as to be after the point in time at which deceleration of the drive motor 111 is started by a delay time ΔT_OFF. If the deceleration rate of a drive motor is proportional to the acceleration rate of the drive motor, the delay time ΔT_OFF is computed so that the following condition is satisfied:

$$\alpha\times(R_BK-R_CL)/Vt0_CL<\Delta T_OFF<\alpha\times Ta_BK$$

where α denotes an arbitrary constant for converting the acceleration time of a motor into the deceleration time of the motor. When the drive motor 111 and the drive motor 112 stop, the process indicated by the flowchart in FIG. 6 is completed.

While the present embodiment has been described with reference to control of drive motors during a color image forming operation performed using the photosensitive drums 101*a* to 101*d*, the present embodiment is applicable to a monochrome image forming operation performed using only the photosensitive drum 101*d*. In such a case, in FIG. 6, after step S603 is completed, the processing may proceed to step S610. In this way, a first printout time needed in a monochrome image forming operation can be reduced, as compared with a first printout time needed in a color image forming operation.

While the present embodiment has been described with reference to the image forming apparatus that transfers toner images formed on a plurality of photosensitive drums onto a recording sheet via an intermediate transfer belt, the present invention is applicable to an image forming apparatus that directly transfers toner images formed on a plurality of photosensitive drums onto a recording sheet conveyed by a conveyer belt. In such a case, the present invention is applicable by regarding the above-described intermediate transfer belt that is driven by a drive motor as a conveyer belt that is driven by a drive motor.

While the present embodiment has been described with reference to phasing performed by starting up the drive motor 111 and the drive motor 112 so that the rotation phase of the drive motor 111 lags behind the rotation phase of the drive motor 112 and accelerating the drive motor 111, the phasing may be performed by starting up the drive motor 111 and the drive motor 112 so that the rotation phase of the drive motor 111 leads the rotation phase of the drive motor 112 and decelerating the drive motor 111. In addition, according to the present embodiment, the drive motor 111 and the drive motor 112 are stopped so that the phase of the photosensitive drums 101*a* to 101*c* is the same or substantially the same as the phase of the photosensitive drum 101*d*, and the drive motor 111 and the drive motor 112 are started so that the phase of the photosensitive drums 101*a* to 101*c* lags behind the phase of the photosensitive drum 101*d*. However, the present invention is not limited thereto. Different phase control may be performed if the phase of the photosensitive drums 101*a* to 101*c* lags behind the phase of the photosensitive drum 101*d* after the startup process has been completed. For example, control may be performed so that the phase of the photosensitive drums 101*a* to 101*c* lags behind the phase of the photosensitive drum 101*d* in the stopping operation.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-185292 filed Aug. 20, 2010, which is hereby incorporated by reference herein in its entirety.

What is claimed is:

1. An image forming apparatus comprising:

a first photosensitive member and a second photosensitive member configured to form images having different colors;

a transfer belt on which the images formed on the first photosensitive member and the second photosensitive member are transferred;

a first DC motor configured to rotate the first photosensitive member and the transfer belt;

a second DC motor configured to rotate the second photosensitive member;

a first detector configured to detect a first rotation phase of the first photosensitive member;

a second detector configured to detect a second rotation phase of the second photosensitive member; and a control unit configured to control the rotation speeds of the first DC motor and the second DC motor, wherein the control unit is configured to perform a startup process to increase a rotation speed of the first and second DC motor in stop states up to a predetermined rotation speed before the image forming apparatus forms an output image, such that when the rotation speeds of the first DC motor and the second DC motor have reached the predetermined speed, the detected second rotation phase lags behind the detected first rotation phase, and wherein, after the rotation speeds of the first DC motor and the second DC motor have reached the predetermined speed, the control unit increases the rotation speed of the second motor while maintaining the rotation speed of the first DC motor at the predetermined speed, and according to a condition that a phase difference between the detected second rotation phase and the first rotation phase became smaller than a predetermined value, rotation speed of the second DC motor is decreased to the predetermined rotation speed while maintaining the rotation speed of the first DC motor at the predetermined speed, wherein diameter of the first photosensitive member and diameter of the second photosensitive member are identical, wherein gear ratio of the first photosensitive member to the first DC motor and gear ratio of the second photosensitive member to the second DC motor are identical, and wherein a predetermined speed set to the first DC motor and a predetermined speed set to the second DC motor are identical.

2. The image forming apparatus according to claim 1, wherein the control unit controls the first and the second DC motors so as to start rotation at the same time and controls the first and the second DC motors so as to stop at the same time.

3. The image forming apparatus according to claim 1, wherein the predetermined speed is a speed for image formation.

4. The image forming apparatus according to claim 1, wherein the control unit is configured to perform image formation after the phase difference between the detected second rotation phase and the first rotation phase becomes equal to or smaller than a predetermined value.

5. The image forming apparatus according to claim 1, wherein the second photosensitive member is provided in a plurality and the second photosensitive members form yellow, magenta, and cyan latent images, and wherein the first photosensitive member forms a black latent image.

6. The image forming apparatus according to claim 1, wherein the predetermined rotation speed is set to each of the first DC motor and the second DC motor.

* * * * *